US005655262A

United States Patent [19]

Sterin et al.

[11] Patent Number: 5,655,262

[45] Date of Patent: Aug. 12, 1997

[54] APPARATUS FOR CLEANING FIBERS

[75] Inventors: Shlomo Sterin; Moshe Kokish, both of Jerusalem, Israel

[73] Assignee: MTM-Modern Textile Machines Ltd., Jerusalem, Israel

[21] Appl. No.: 553,054

[22] Filed: Nov. 3, 1995

[30] Foreign Application Priority Data

| | | | |
|---|---|---|---|
| Nov. 3, 1994 | [IL] | Israel | 111520 |
| Feb. 26, 1995 | [IL] | Israel | 112791 |

[51] Int. Cl.[6] ..... D01B 5/08

[52] U.S. Cl. ..... 19/200; 19/114

[58] Field of Search ..... 19/200, 202, 203, 19/204, 205, 106 R, 112, 114, 113, 98, 99

[56] References Cited

U.S. PATENT DOCUMENTS

| | | | |
|---|---|---|---|
| 2,835,929 | 5/1958 | Taine et al. | 19/99 |
| 3,051,996 | 9/1962 | Varga | 19/99 |
| 4,090,276 | 5/1978 | Roberts | 19/99 |
| 4,115,903 | 9/1978 | Barber | 19/99 |
| 4,128,917 | 12/1978 | Varga | 19/98 |
| 4,129,924 | 12/1978 | Wirth | 19/99 |
| 4,219,908 | 9/1980 | Winch et al. | 19/99 |
| 4,523,350 | 6/1985 | Schmiedgen et al. | 19/98 |
| 4,712,276 | 12/1987 | Krusche | 19/99 |
| 4,852,217 | 8/1989 | Bernhardt et al. | 19/98 |
| 4,858,276 | 8/1989 | Frosch et al. | 19/98 |
| 4,958,404 | 9/1990 | Lasenga | 19/98 |

*Primary Examiner*—Michael A. Neas
*Attorney, Agent, or Firm*—Browdy and Neimark

[57] ABSTRACT

The invention provides apparatus for cleaning fibers by a combination of revolving rollers, including a first roller arranged to hold and collect fibers from a supply source, a second roller arranged to take off fibers from said first roller, a third roller driven faster than either of the first or second rollers and arranged to receive, expand, card and eject fibers from the second roller. At least one of the first or second rollers is provided, over the entire surface thereof, with a plurality of pointed, toothlike projections, a first quantity of the projections pointing in the direction of rotation of the roller and a second quantity of the projections pointing in the direction opposite to the direction of rotation of the roller. A fiber mass to be cleaned is divided, expanded and recombined while being successively transferred over the three rollers.

14 Claims, 10 Drawing Sheets

FIG. 1
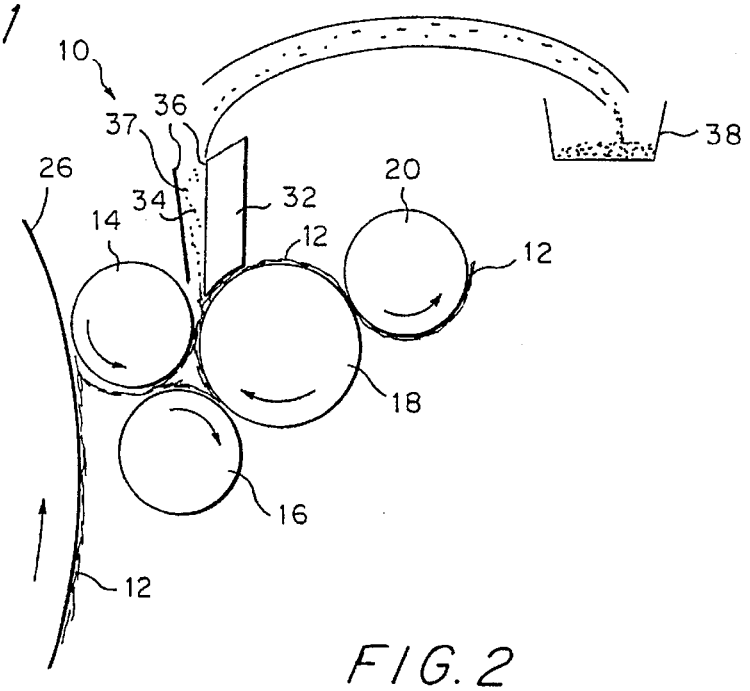
FIG. 2
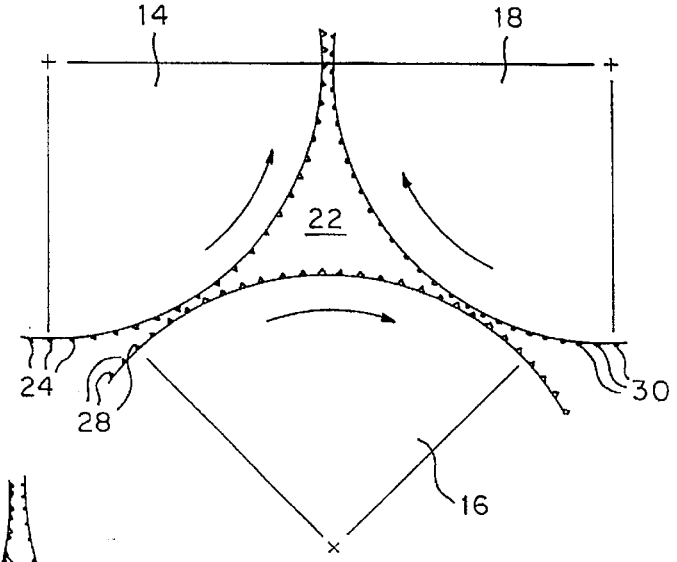
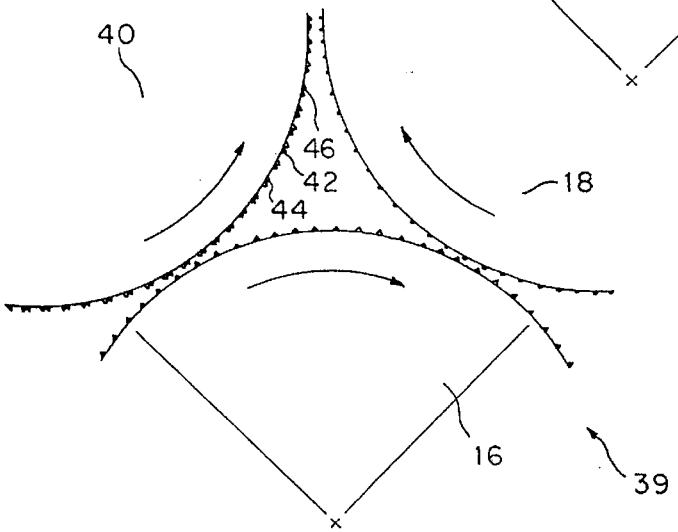
FIG. 3

FIG. 7
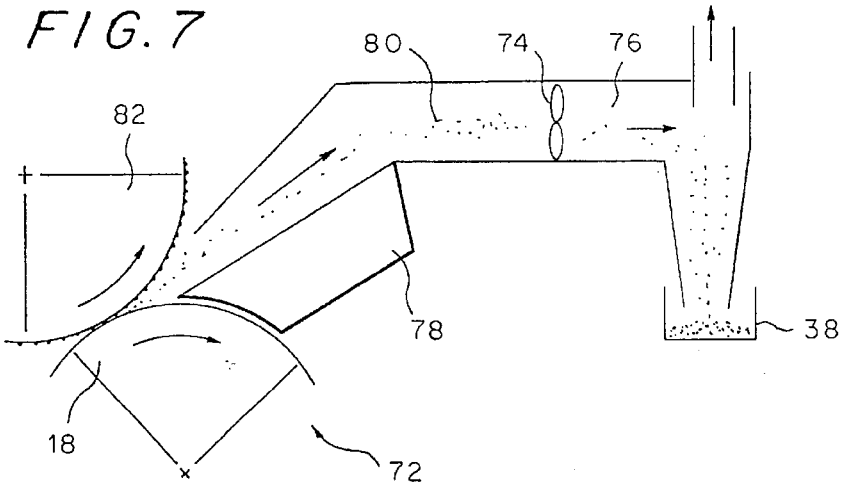
FIG. 8
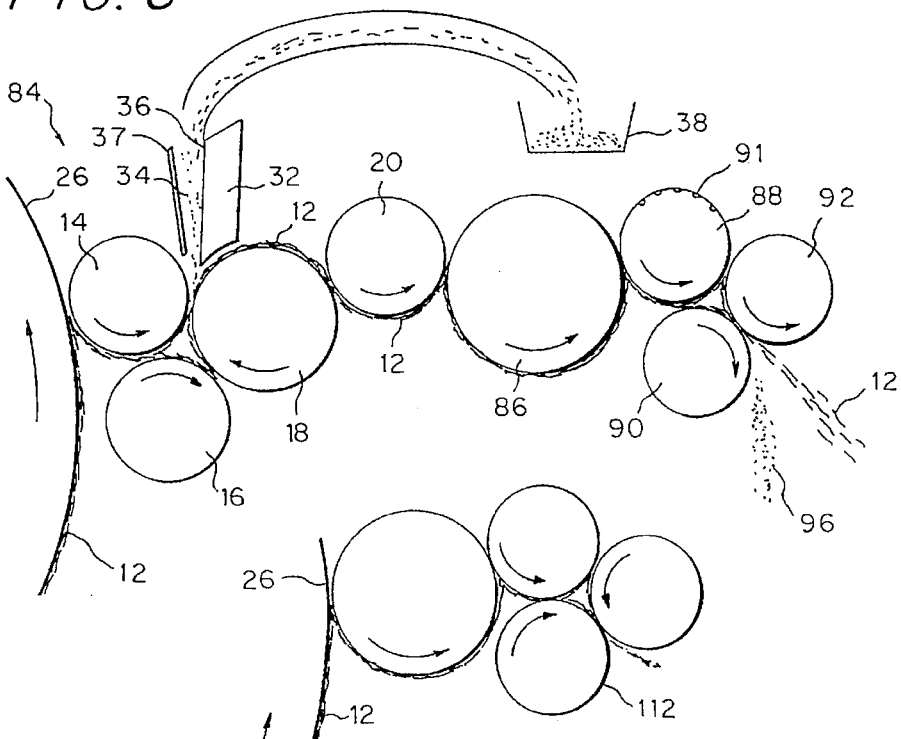
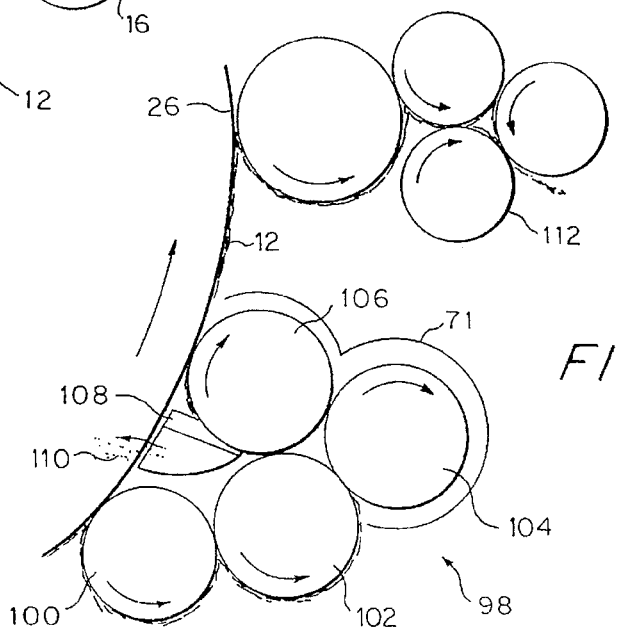
FIG. 9

FIG. 15A
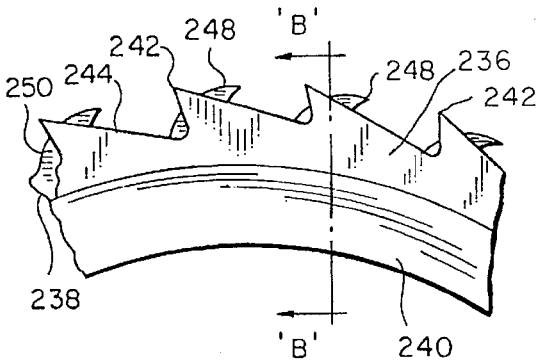
FIG. 15B
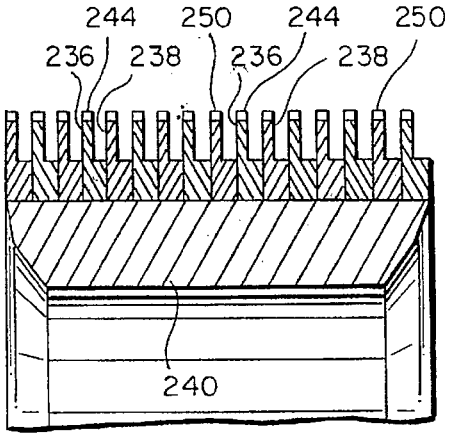
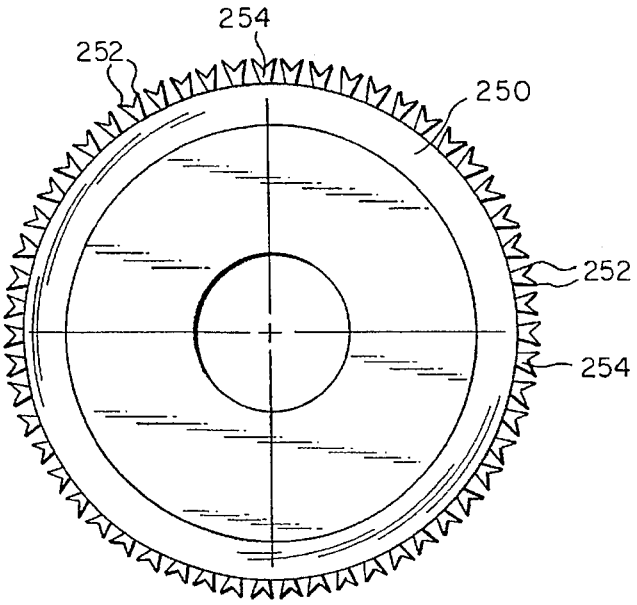
FIG. 16A
FIG. 16B
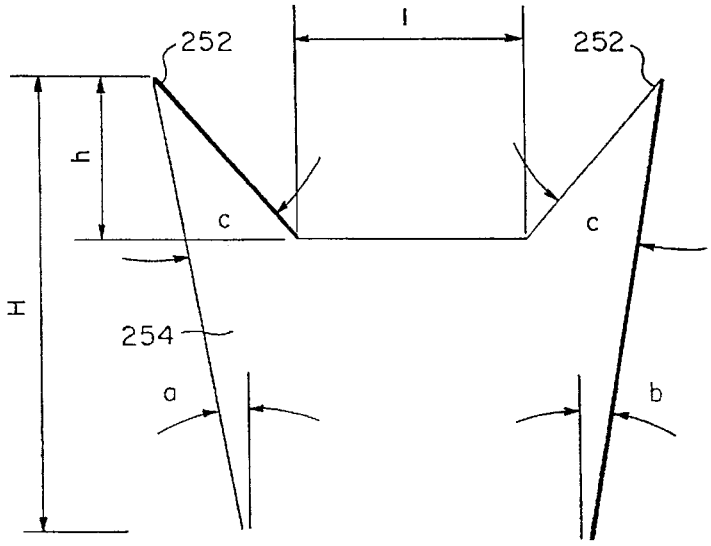

APPARATUS FOR CLEANING FIBERS

The present invention relates to an apparatus for cleaning fibers such as cotton fibers, by removing waste particles therefrom. More particularly, the invention concerns a fiber-processing roller, and a textile fiber processing machine using said roller. The invention also provides means to carry out a plurality of textile fiber processes, typically carding and stripping, using a roller provided with teeth facing in different directions.

The steps for transforming the baled cotton into fine cotton yarn are multiple, and require different stages of processing in different machines which have been developed over the past two hundred years.

As described in the literature, e.g., in *Manual of Cotton Spinning,* Textile Institute and Butterworth & Co. Ltd. (1965), after the opening of a bale, one of the first stages of processing is performed with a carding machine. Carding is defined as the reduction of an entangled mass of fibers to a filmy web by working the fibers between two closely spaced, relatively moving surfaces clothed with sharp points.

As reported in said Manual, baled cotton contains a small percentage of trash, i.e. particles of leaf, seed, coat and stalk from the cotton plant and also sand and soil from the ground in which the plants were grown, and about 70–80% of this trash falls away when the bale is opened. The remaining 20–30% is imprisoned in the tufts of cotton, and some of it is firmly attached to the fibers themselves. It is a function of the carding process to remove as much of the trash as possible from the cotton. The fine action of the card breaks up the tufts and therefore releases some of the trash for rejection, and the wire surfaces on the carding parts retain a proportion of the residue so that after carding, a percentage of the original trash, depending on the type of trash and on the carding action, is left in the sliver.

During processing, cotton is fed to a doffer of a carding machine, but some trash is still present at this stage. It is obvious that high quality textiles cannot be produced unless such particles are removed from the fibers. Furthermore, such particles, if not removed, are likely to damage or erode operating components of spinning and other machinery used for further processing, or to cause stoppages due to thread breakage.

Traditional combing machines arranged to effect such separation are complicated and do not have high throughput rates. Furthermore, such machines tend to damage the fibers with the consequent inclusion of an undesirably high percentage of short fibers in the material being processed. Short fibers are detrimental to the spinning process and reduce the tensile strength of the produced thread.

Prior art carding devices are based on flat or cylindrical surfaces, which are covered with a large number of single-function teeth. Relative movement of two such surfaces produces a carding action. Thereafter, a stripping action is necessary, wherein the fibers are removed from the carding surfaces and transferred to further processing. The stripping action, as such, makes no contribution to the processing of the fibers.

It has now been found that a roller, if provided with teeth facing in opposite directions, provides previously unknown possibilities of almost simultaneously carrying out more than one of the various processes used in the processing of textile fibers. Furthermore, the roller can be adapted to carry out different functions by arranging the teeth in a manner appropriate to such function, as will be shown.

It is therefore one of the objects of the present invention to obviate the disadvantages of the prior art devices for separating trash particles from textile fibers, and to provide an apparatus using toothed rollers which is operable at a high throughput rate.

Another object of the present invention is to effect an improvement in prior art textile fibers processing machines, by providing a roller which allows two processes to be carried out simultaneously.

It is a further object of the invention to provide means for effecting carding while causing less damage to fibers than in prior art arrangements.

It is a still further object of the present invention to remove such trash particles from the textile fibers, while preventing damage or length reduction to the fibers being processed.

The present invention achieves the above objectives by providing an apparatus for cleaning fibers by means of a combination of revolving toothed rollers, the fiber mass being divided, expanded and recombined while being successively transferred over at least four rollers; the outer surface of at least one of said rollers revolving in close proximity to, but spaced apart from, two other rollers to form a triangular enclosure therebetween, said apparatus comprising a first roller arranged to collect fibers from a moving supply source and to effect the division and carding thereof; a second rollers driven at a peripheral speed different from that of said first roller, arranged to collect part of said fibers from said first roller and to expand said fiber mass collected therefrom, the resultant division and expansion of said fibers mass, and carding thereof, allowing ejection of at least some waste particles; a third roller driven at least 5 times faster than either said first or said second roller, and arranged to receive, expand, card and eject fibers from said first roller and said second roller, and to eject waste particles from said fibers; a fourth roller arranged to receive, collect and condense fibers from at least said third roller, and at least one separator blade held in proximity to one of said rollers for separating waste particles.

In a preferred embodiment of the present invention, there is provided an apparatus for cleaning fibers wherein a separating blade is held under and in proximity to at least one of said rollers, whereby heavy waste particles impinge on said blade and are separated from said fibers by gravity, centrifugal force, and aerodynamic forces.

In a further preferred embodiment of the present invention, there is provided such a roller wherein each of said sequential pairs of oppositely-pointing projections is formed as a single, forked, double-pointed tooth.

According to another preferred embodiment of the invention, there is provided, in a fiber-processing installation, a rotatable roller including, over the entire active surface thereof, a plurality of pointed toothlike projections, a first quantity of which point in the direction of rotation of said roller, and a second quantity of which point in the direction opposite to the direction of rotation of said roller.

According to a still further embodiment of the present invention, there is provided an apparatus for processing fibers by means of a combination of revolving rollers, said apparatus comprising a fiber supply means; a first rotatable roller, provided, over the entire active surface thereof, with a plurality of pointed tooth-like projections, a first quantity of which point in the direction of rotation of said roller, and a second quantity of which point in the direction opposite to the direction of rotation of said roller; a second rotatable roller provided, over the entire active surface thereof, with a plurality of teeth of uniform orientation pointed in the direction of rotation of said roller; the arrangement being such that the outer surface of said first roller revolves in close proximity to said fiber supply means to collect fibers therefrom, and said second roller revolves in close proximity to said first roller; the teeth of said second roller interengage with the projections of said first roller, said interengagement being such that a plurality of substantially axially-aligned teeth of said second roller transfers fibers from a plurality of said first quantity of tooth-like projections of said first roller to a plurality of said second quantity of tooth-like projections of said first roller, and said same plurality of substantially axially-aligned teeth of said second roller then cards said fibers in respective point-to-point conjunction with the plurality of said second quantity of tooth-like projections to which said fibers have been transferred.

The invention also provides apparatus for cleaning fibers by means of a combination of revolving rollers, comprising a first roller arranged to hold and collect fibers from a supply source; a second roller arranged to take off fibers from said first roller; a third roller driven faster than either of said first or second rollers and arranged to receive, expand, card and eject fibers from said second roller; at least one of said first or second rollers being provided, over the entire surface thereof, with a plurality of pointed, toothlike projections, a first quantity of said projections pointing in the direction of rotation of said roller and a second quantity of said projections pointing in the direction opposite to the direction of rotation of said roller; wherein a fiber mass to be cleaned is divided, expanded and recombined while being successively transferred over at least said three rollers.

It will thus be realized that the novel fiber-dirt separator apparatus of the present invention divides and expands the fiber mass to ease removal of particles embedded therein. As separation of toothed rollers is maintained, these operations are carried out without tearing the fibers. Furthermore, the novel roller of the present invention can be utilized in many textile fiber processes, such as carding, stripping, combing, feeding, pre-opening, cleaning and condensing.

In an especially preferred embodiment of the present invention, said first roller is provided with dual-function teeth, a portion of said teeth being arranged to effect the collection of fibers from said supply source and another portion of said teeth being formed to affect carding in conjunction with an adjacent toothed roller.

The various separation modes provided by the invention take into account the fact that not all waste particles are alike. For example, separation by centrifugal force is most effective for high density particles, such as those of metal; separation by air stream is effective for low density particles, and crushing and pulverising are suitable for hard, brittle waste such as soil.

The high output rates and simplicity of the mechanism are made possible by using revolving rollers while avoiding reciprocating components.

As is known in the literature, fundamentally, there are two important actions, performed with carding surfaces: carding and stripping. The action which takes place between two clothed surfaces depends upon the inclination of the wire and/or teeth, and the direction and rate of their motion in relation to each other.

Carding action is accomplished when the wires or teeth of the two surfaces are inclined in opposite directions. The direction and rates of motion should be such that one surface passes the other point against point. This action may result from both surfaces going in the same direction, with the lower surface moving rapidly past the upper surface; or the action may be obtained by having the surfaces move in opposite directions, each in the direction of inclination of the wires or teeth. Carding action results in complete opening of the tufts of the lap.

Stripping action is accomplished when the wires or teeth of two surfaces point in the same direction. With this arrangement, the action is point against smooth side. The surface which moves the faster lifts the cotton away from the other wire or tooth, and collects it. Stripping is used in transferring cotton from one surface to another, and in removing it from a surface.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodies in practice.

In the drawings:

FIG. 1 is a schematic view of a preferred embodiment of the apparatus according to the invention;

FIG. 2 is a detailed, schematic view of part of the same apparatus shown in FIG. 1, but without the fibers;

Figure 3A:
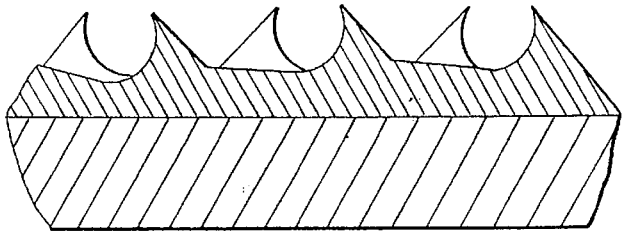
Figure 3B:
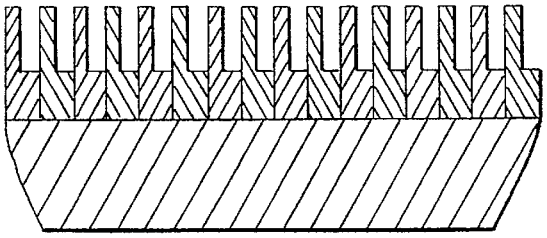
Figure 3C:
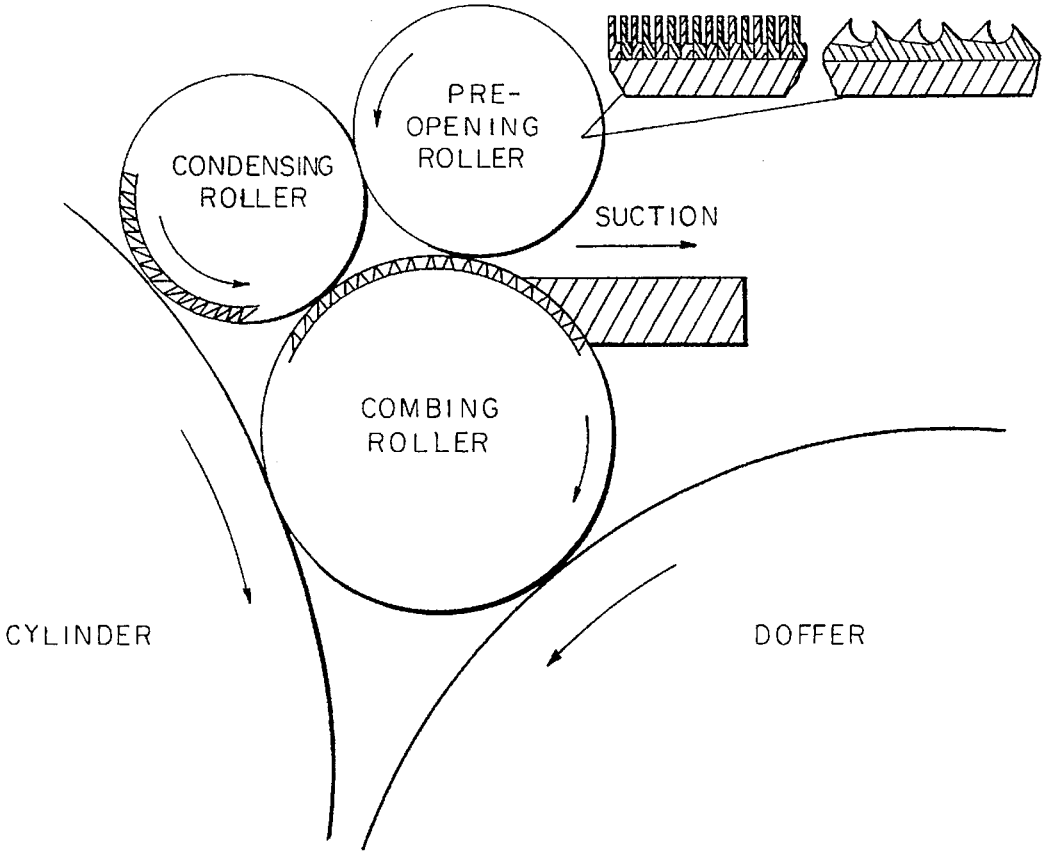
Figure 4:
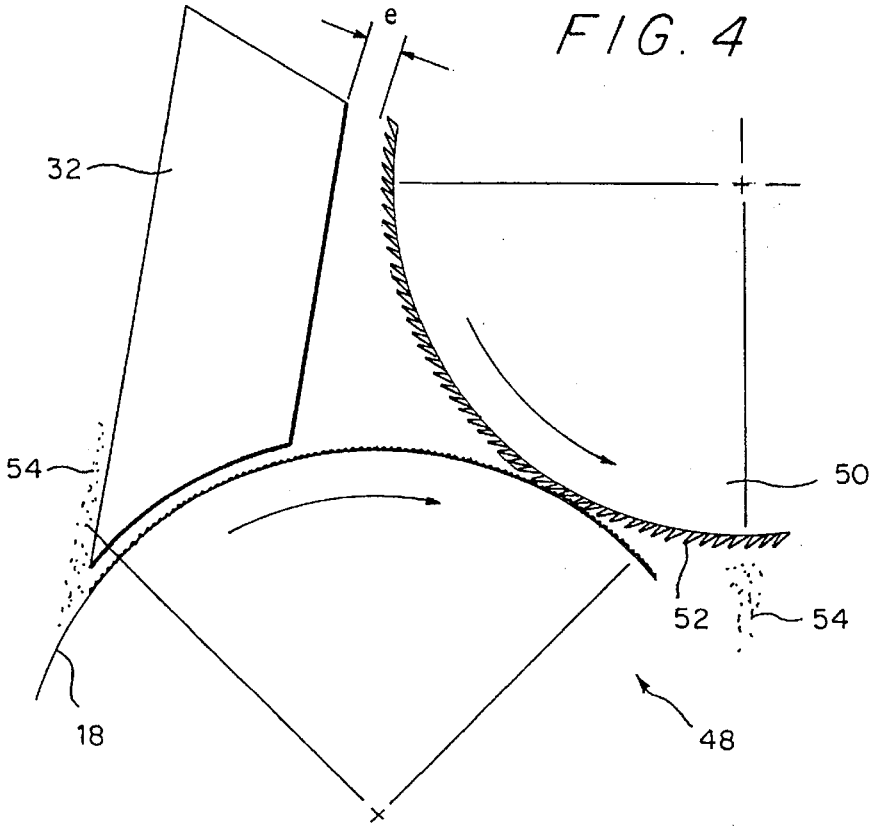
Figure 5:
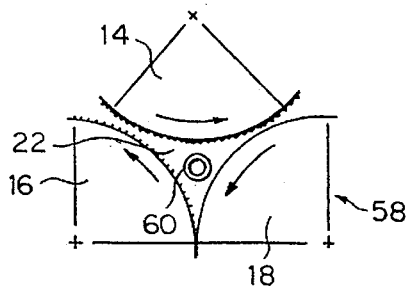
Figure 6:
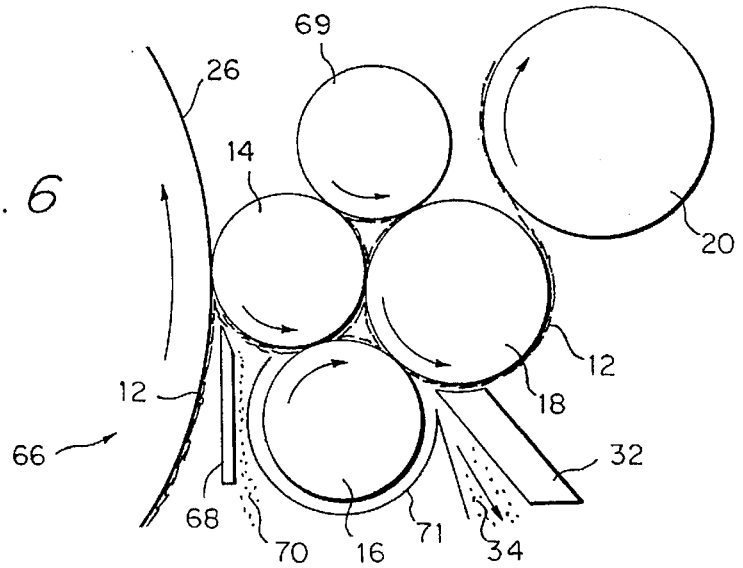
Figure 10:
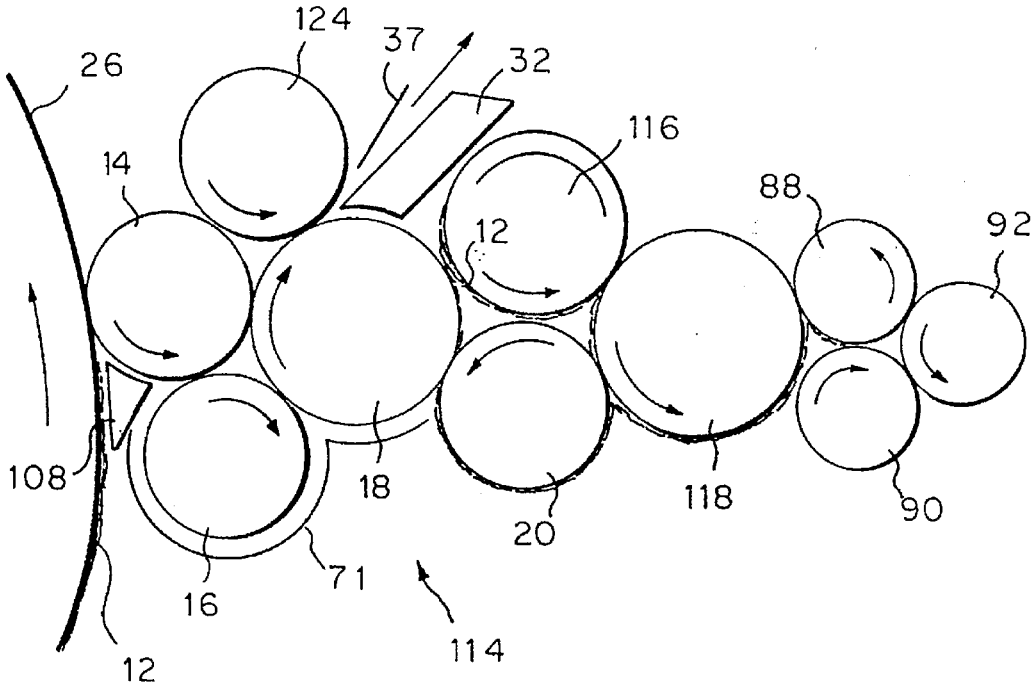
Figure 11:
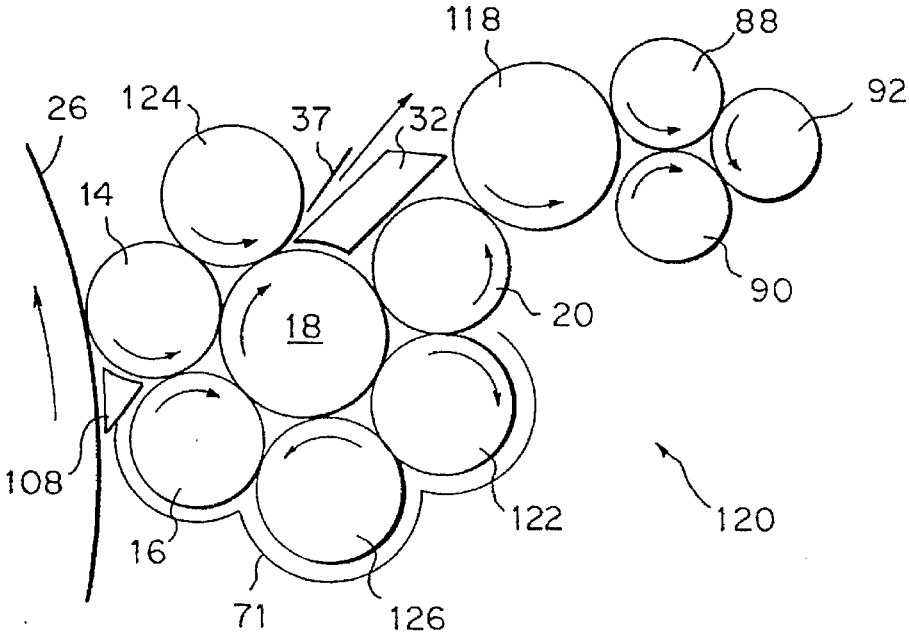
Figure 12:
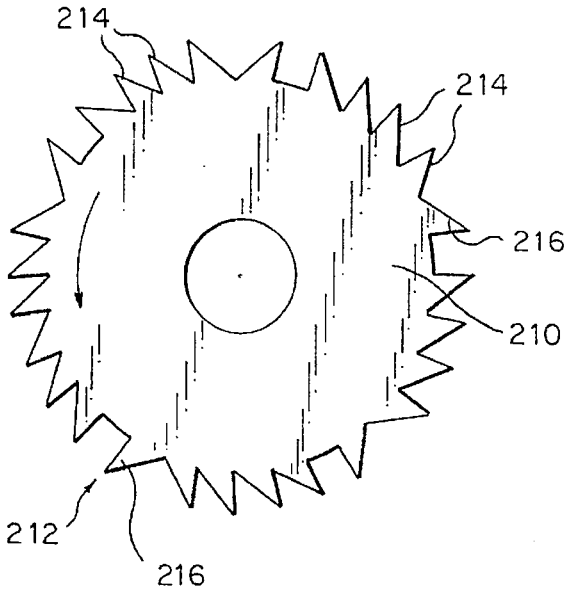
Figure 13A:
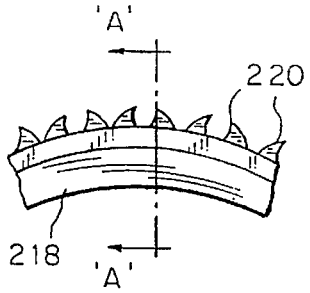
Figure 13B:
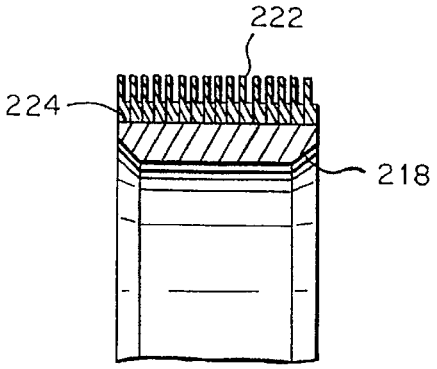
Figure 14:
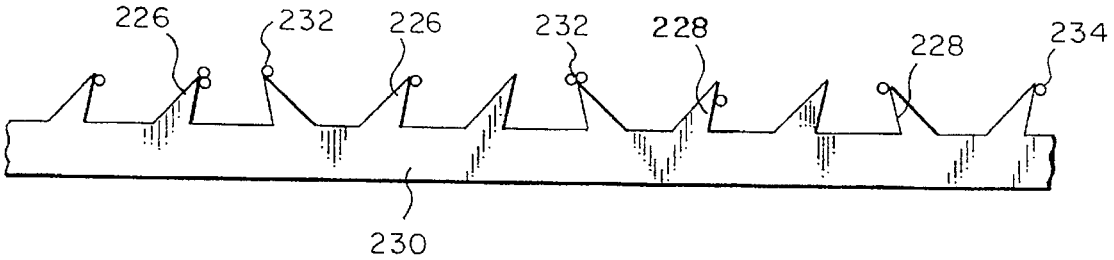
Figure 17A:
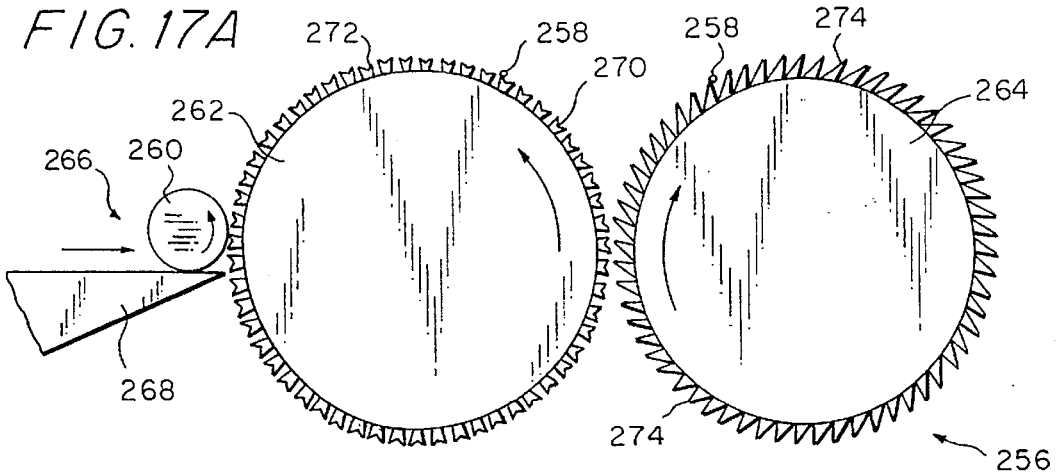
Figure 18:
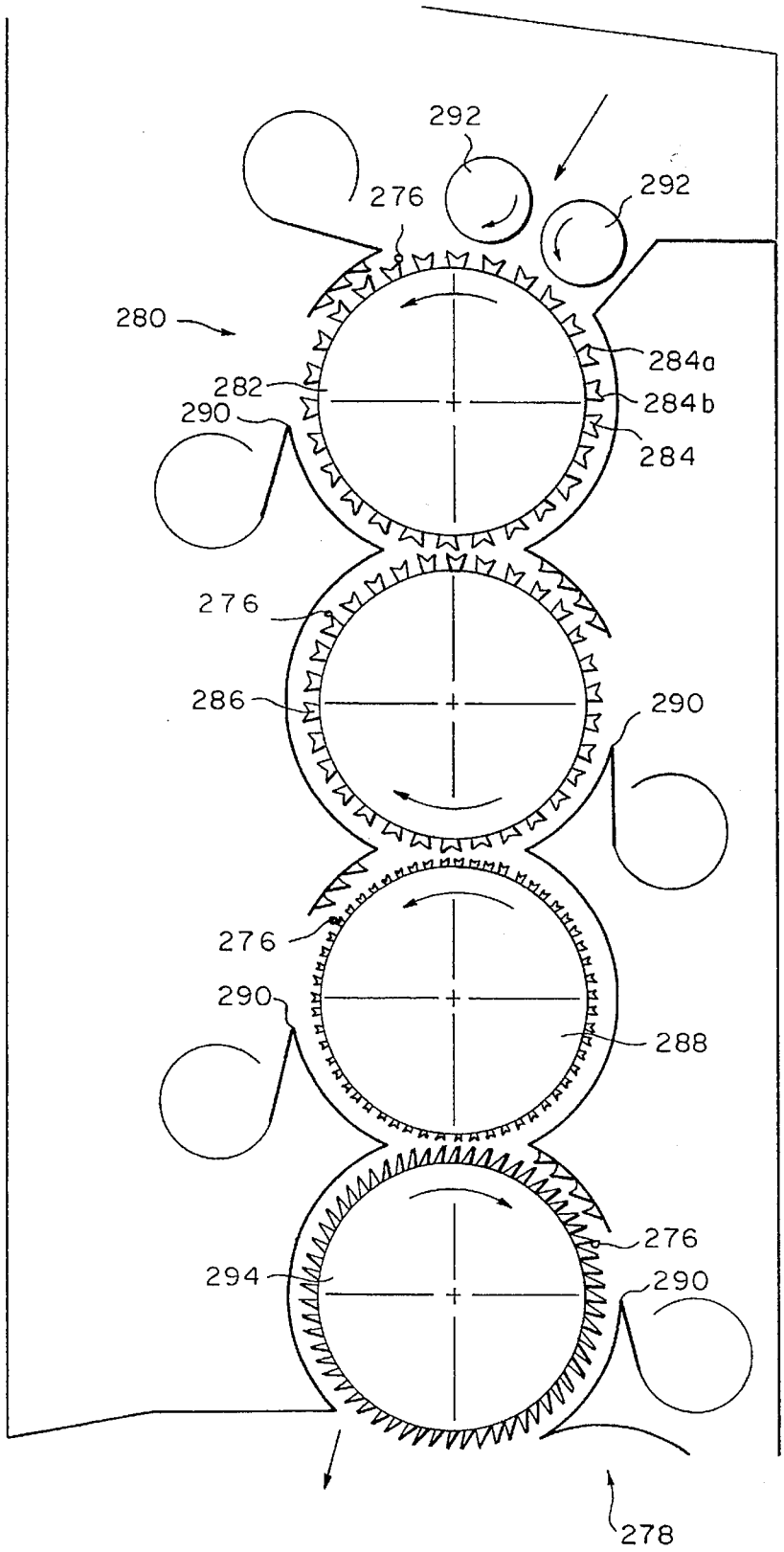
Figure 19:
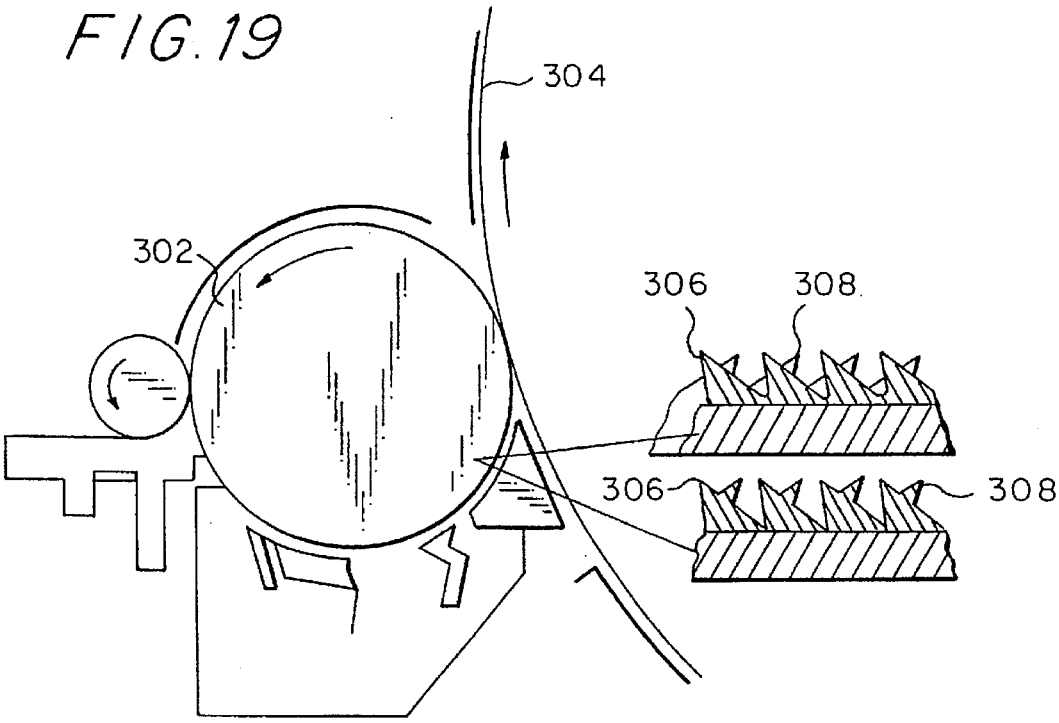
Figure 20:
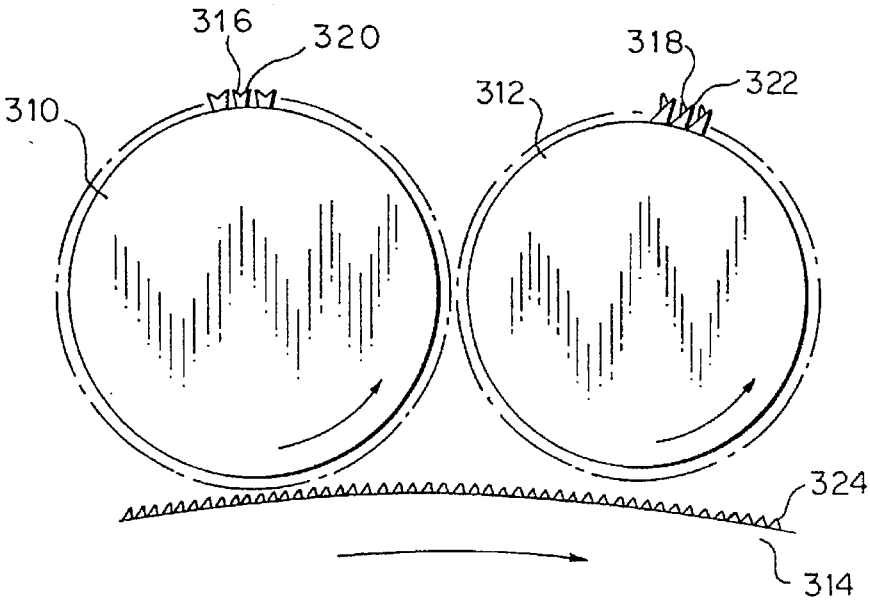

FIGS. 3*a*–3*c* are schematic views of the detail of an apparatus similar to that shown in FIG. 1, but wherein the distributor roller is provided with dual-function teeth;

FIG. 4 is a schematic view of the detail of an apparatus provided with an air suction tube in proximity to three rollers;

FIG. 5 is a schematic view of apparatus with a trap for waste particles;

FIG. 6 is a schematic view of the detail of an apparatus similar to that shown in FIG. 1, but wherein the condensing roller is provided with fiber-engaging teeth;

FIG. 7 is a schematic view of the detail of an apparatus wherein a second separation blade is provided;

FIG. 8 is a schematic view of apparatus equipped with rollers having point-to-point teeth;

FIG. 9 is a schematic view of an apparatus wherein the fibers are returned to the doffer after preliminary cleaning, and are again removed therefrom for further processing;

FIG. 10 is a schematic view of an embodiment of the invention which is provided with a condenser roller;

FIG. 11 is a schematic view of an embodiment of the invention which is provided with further additional rollers;

FIG. 12 is an elevational view of a preferred embodiment of a roller according to the invention;

FIG. 13A is a fragmented, elevational view of a roller built using an attached strip;

FIG. 13B is a sectional view, taken at AA, of the roller shown in FIG. 13A;

FIG. 14 is a straightened, elevational view of some of the teeth of a roller, where each quantity of pointed tooth-like projections has its own period of arrangement;

FIG. 15A is a fragmented, elevational view of a roller built using two attached strips;

FIG. 15B is a sectional view, taken at BB, of the roller shown in FIG. 15A;

FIG. 16A is an elevational view of a roller provided with forked, double-pointed teeth;

FIG. 16B is an enlarged, diagrammatic view of one of the teeth shown in FIG. 16A;

FIG. 17A is a diagrammatic view of an apparatus using a roller of the type seen in FIG. 16A;

FIGS. 17B, 17C, 17D and 17E are detailed views of some roller teeth of the apparatus of FIG. 17A in straightened form, during the various stages of carding and stripping;

FIG. 18 is a diagrammatic view of an apparatus used for carding and cleaning, wherein the fiber supply means is a rotatable roller of the type shown in FIG. 16A;

FIG. 19 is a diagrammatic view of an apparatus according to the present invention, wherein the tooth arrangement described below with reference to FIG. 17A is embodied in a Lickerin-cylinder arrangement; and FIG. 20 is a diagrammatic view of an apparatus according to the present invention, using dual-function teeth on the worker and stripper rollers of a roller card machine.

There is seen in FIG. 1 an apparatus 10 for cleaning fibers 12 by means of a combination of revolving toothed rollers. Apparatus 10 causes the fiber mass to be divided, expanded and recombined while being successively transferred over at least three rollers 14, 16 and 18, as will be described further below.

The outer surface of roller 14 revolves in close proximity to, but spaced apart from, two other rollers 16, 18, as seen in the detail shown in FIG. 2. A roughly triangular enclosure 22 is formed between the rollers 14, 16, 18. Enclosure 22 has been found to prevent undesired air turbulence and is beneficial for the prevention of unintended fiber dispersal.

A first roller 14, which is the distributor roller, is provided with teeth 24 arranged to collect fibers 12 from a moving supply source 26, here shown as a doffer. The first roller 14 is driven in the direction of the arrow at about 200 revolutions per minute (RPM). Advantageously, the peripheral speed of the first roller is up to 20% higher than the peripheral speed of the supply source 26.

A second roller 16, which is the preopener roller, is driven at a peripheral speed different from the first roller 14. In this embodiment, the speed of the second roller is greater than that of the first roller. It is provided with teeth 28 which are arranged to collect part, but not all, of the fibers 12 from the first roller 14. Due to the different peripheral speeds of these rollers, the fiber mass is expanded, as only a portion of the fiber mass is collected by the second roller, the fiber mass is also divided.

A third roller 18, which is the combing roller, is driven at least 5 times faster than either the first or the second roller 14, 16. In this embodiment, the third roller 18 is driven at about 3000 RPM. The third roller 18 has teeth 30 which are finer than those of rollers 14, 16. The third roller 18 typically has a diameter of between 10 and 25 cm.

The combing roller receives fibers from the preopener roller, expands and cards them, and, due to large centrifugal forces, ejects waste particles onto the surface of the distributing roller, where they are held by fibers. The combing roller receives fibers from the distributing roller, expands them, and, due to the fact that the waste particles are situated on the fibers on the surface of the distributing roller, effectively ejects them into the zone of interaction with separator blade 32.

An optional fourth roller 20, which is a condensing roller, is arranged to collect, receive, and condense the fibers from the third roller 18 for transfer to the next processing stage.

A separator blade 32 extends along the length of third roller 18 and is held in proximity thereto. Fibers 12 pass underneath blade 32, but the shortest fibers and waste particles 34 impinge the blade side 36. Furthermore, waste particles and fibers which are situated on the outer layer of the surface of combing roller 18 interact effectively with separator blade 32, thus improving the cleaning of fibers 12. The particles 34 enter a dust passage 37, which leads from the vicinity of separator blade 32 to a dust collection container 38.

FIG. 3 depicts the details of apparatus 39, which is similar to that shown in FIG. 1. In this embodiment, the first distributor roller 40 is provided with dual-function teeth 42, a first tooth edge 44 being arranged to effect collection of fibers 12 from the supply source 26 seen in FIG. 1, and an opposite edge 46 being formed to effect carding in conjunction with an adjacent toothed roller 16, the preopener roller.

The preopener roller may also be provided with dual-function teeth, and may revolve in either the clockwise or counter-clockwise direction, resulting in the improved carding of fibers.

The distributor roller 14 effects carding in two stages: first against the preopener roller 16, and again against the combing roller 18. The resulting improved orientation of fibers 12 is helpful in the following stages of the process.

FIG. 5 illustrates the details of an apparatus 58 for cleaning fibers, further provided with a tube 60 positioned in the curved triangle 22 formed between three toothed rollers 14, 16 and 18. Tube 60 may be used for supplying a flow of compressed air; it may be perforated, and may revolve for improved moving of fibers. The supplied air flow reduces air turbulence caused by the revolving toothed rollers 14, 16 and 18, and prevents fiber intertangle.

FIG. 5 depicts details of an apparatus 58 for cleaning fibers, further provided with a trap for waste particles, which are collected and removed as part of the cleaning process through the application of suction. Distances $L_1$ and $L_2$ define the efficiency of the cleaning of the fibers.

Air gaps "a" and "b" define the velocity of the air stream between separator blade 32 and plate 37, and allow the regulation of the quantity and quality of waste 34 which is ejected.

Referring now to FIG. 4, there is seen apparatus 48 for cleaning fibers, wherein condensing roller 20 is provided with fiber-engaging teeth 52 and is driven at a peripheral speed about 5 times less than that of the combing roller 18. Teeth 52 slope in the direction opposite to that in which the condensing roller 20 is driven, and consequently collect the major portion of fibers from combing roller 18. The air gap "d" between rollers 18 and 20 lies in the range of from 0.2 to 1.5 mm. Distance "e", signifying the air gap between the rear face of separator blade 32 and teeth 52, is in the range of from 5 to 12 mm. Gap "e" is kept small, to prevent fibers from flowing therethrough.

Seen in FIG. 6 is an apparatus 66 for cleaning fibers 12, wherein a separating blade 68 is held under and in proximity to a first roller 14. Thereby, heavy waste particles 70 impinge on the blade 68 and are separated from fibers 12 by gravity and centrifugal force.

Apparatus 66 includes a stripping roller 69 which removes any fibers 12 remaining on the distributor roller 14 and the combing roller 18, and transfers these fibers to the air condensor 116, where all fibers are collected. A fiber retainer guard 71 is shown partially surrounding some of the rollers; the guard 71 reduces fiber loss from the roller periphery.

FIG. 8 illustrates triangular enclosure 14, 18, 16, showing that the direction of the teeth of each two adjacent rollers is point against point. The preopener roller rotates slowly, about 20% less than the speed of the distributing roller. The combing roller cards fibers between the teeth of both the distributing roller and the preopener roller.

FIG. 9 shows another embodiment of apparatus 98 for cleaning fibers.

Rollers 102, 104, 106 are in surface proximity and have mutually different peripheral velocities. This embodiment operates without an additional condensing roller.

Typical roller speeds are as follows: the distributor roller operates at a speed of up to about 20% more than the speed of the doffer 26; the preopener roller 104 operates at a speed of either about 20% or more, or 20% less, than the distributor roller, and the combing roller 106 operates at a speed of about 10 times that of the distributor roller.

A separator blade 108 is held in proximity to combing roller 106, and waste 110 is extracted by suction means from near the combing roller 106, which returns the cleaned fibers to the supply source 12, shown as a doffer, for further processing by known grooved roller 88, crush rolls 90, 92, and take-off roller 118.

A further embodiment of an apparatus 114 for cleaning fibers 12 is shown in FIG. 10. While generally similar to previously-described embodiments, this embodiment is provided with a condenser 116 in addition to the condensing fourth roller 20 described with reference to FIG. 1, which collects most of the fibers from the combing roller 18.

Condenser 116 collects some of the fibers from the combing roller 18, although being substantially spaced apart therefrom. These collected fibers are then transferred to take-off roller 118, which thus receives fibers from two sources.

The embodiment of FIG. 10 also includes a toothed working roller 124. Experiments have shown that roller 124 improves the effectiveness of dust separation in combination with separator blade 32.

FIG. 11 shows another embodiment of the apparatus 120, having a compression roller 122. Roller 122 is smooth and serves to stabilize air currents. It also helps to compress the fibers onto condensing roller 20.

Also shown in FIG. 11 are a working roller 124 and a stripping roller 126, which serve to improve the fiber cleaning.

There is seen in FIG. 12 a rotatable roller 210 suitable for use in a fiber processing installation, for example, as one of the elements in a carding device, which will be described further below with reference to FIG. 17A. Roller 210 is provided with a plurality of pointed, tooth-like projections 212 over its active surface. A first quantity 214 of these projections points in the direction of rotation of the roller 210; a second quantity 216 of these projections point in the opposite direction. Quantities 214, 216 as shown in the present embodiment are unequal, but, depending on the functions to be carried out, they may be equal.

Examples of suitable tooth shapes are shown in the drawings; a preferred form of tooth will be described below with reference to FIG. 16B.

Referring now to FIGS. 13A and 13B, there is seen a further roller 218, similar to that shown in FIG. 12. Pointed tooth-like projections 220 are provided on an outwardly-facing edge 222 of strip 224, which is spirally wound about, and attached to, roller 218. Some of the projections 220 point in the direction of rotation of roller 218, and some point in the opposite direction.

FIG. 14 shows, in straightened form, teeth 226, 228 attached to a roller 230, similar to that shown in FIG. 12. In FIG. 14, it is seen that each quantity of pointed tooth-like projections has its own period of arrangement of teeth. This arrangement is of particular benefit in preventing fibers 232 from being unintentionally removed from a first quantity of teeth by a directed air flow, in that said fibers are then caught and retained by said second quantity of oppositely-pointed tooth-like projections.

FIGS. 15A and 15B illustrated the tooth formation of strips 236, 238, attached to roller 240, which is similar to that shown in FIGS. 13A and 13B. A first quantity of pointed tooth-like projections 242 is provided on an outwardly-facing edge 244 of the first strip 236, which is spirally wound about, and attached to, roller 240. Similarly, a second quantity of pointed tooth-like projections 248 is provided on an outwardly-facing edge 250 of the second strip 238. Second strip 238 is intercalated with the first strip 236. The second quantity of pointed tooth-like projections 248 points in the direction opposite that of said first quantity of projections 242.

It can be seen in the drawings that each of the strips 236, 238 has its own tooth design and period of spacing between sequential teeth. The design is chosen to optimize the particular operations to be carried out.

Referring now to FIG. 16A, there is seen a roller 251, wherein each of the sequential pairs of oppositely-pointing projections 252 is formed as a single, forked, double-pointed tooth 254.

One of said teeth 254, drawn on an enlarged scale, is shown in FIG. 16B. Angles a and b are shown at 10°, the typical range being from −15° to 30°. Angle c is shown as 30°, the typical range being from 15° to 105°. Distance I may be between 0–10 mm. Distance h may be between 0 and dimension H.

FIG. 17A depicts an apparatus 256 for processing fibers 258 by means of a combination of revolving rollers 260, 262 and 264.

FIGS. 17B, 17C, 17D, and 17E show the roller teeth of rollers 262, 264 in straightened form during various stages of carding and stripping performed by apparatus 256.

Fiber supply means 266 receives and transports the fibers to the following stage. Advantageously, the fiber supply means is a feed roller 260 and a feed plate 268. The second main component is a first rotatable roller 262, provided, over the active surface thereof, with a plurality of pointed tooth-like projections 270, 272. A first quantity of said projections 270 points in the direction of rotation of roller 262; a second quantity of projections 272 points in the opposite direction. The third main component of the apparatus 256 is a second rotatable roller 264, provided, over the active surface thereof, with a plurality of teeth 274, of uniform, substantially axially aligned orientation, and pointed in the direction of rotation of roller 264.

Operation of the apparatus can be readily understood by perusal of FIGS. 17B, 17C, 17D and 17E, which show successive stages of fiber processing. The upper part of each figure represents a small sector, in straightened form, of the first rotatable roller 262; the lower part of each figure represents a small sector, in straightened form, of the second rotatable roller 264. Rollers 262, 264 revolve in opposite directions, the effect being that the two sectors of the rollers which are in close proximity move in the same direction. However, the second rotatable roller 264 is driven at a peripheral velocity $V_2$, which is substantially faster than the velocity $V_1$ of the first roller 262.

Figure 17B:
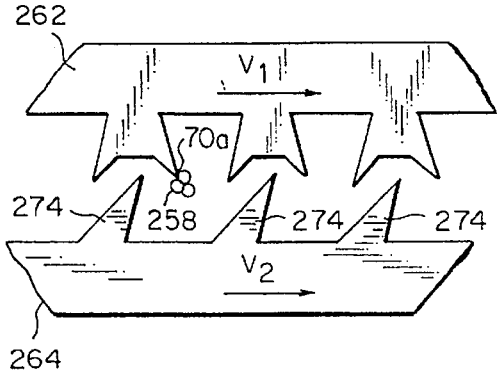
Figure 17C:
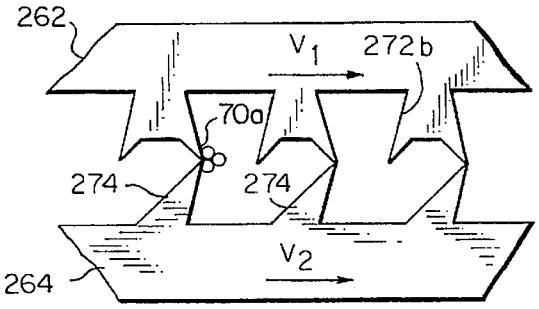
Figure 17D:
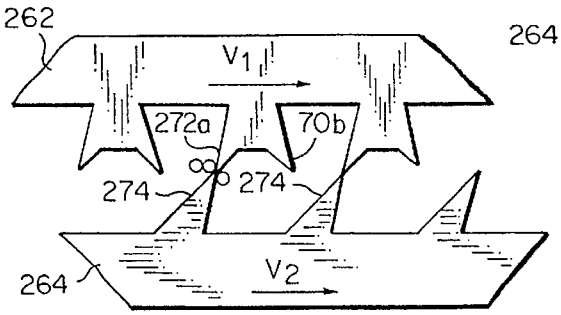

As seen in FIGS. 17A and 17B, the first rotatable roller 262 has collected fibers 258 from the supply means 266. The second roller 264 revolves in close proximity to the first roller 262, and the teeth 274 of the second roller 264 interengage with the projections 270, 272 of the first roller 262, as seen in FIGS. 17C and 17D. During the first stage, this interengagement is such that a plurality of teeth 274 transfers fibers 258 from a plurality of the first quantity of tooth-like projections 270*a* of first roller 262 to a plurality of the second quantity of tooth-like projections 272*a*, also on first roller 262.

Figure 17E:
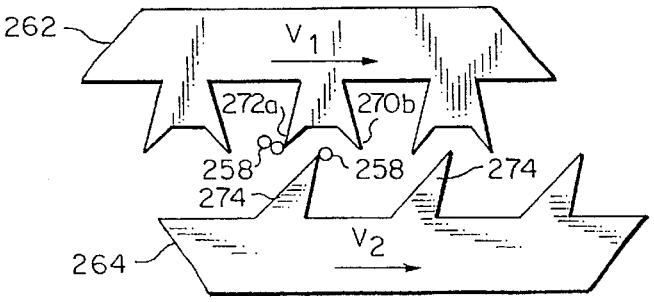

Referring now to FIGS. 17D and 17E, it is seen that said same plurality of teeth 274 of the second roller 264 then cards the fibers 258 in respective point-to-point conjunction with the second quantity of tooth-like projections 272*a* of the first roller 262, to which projections the fibers 258 have been transferred. Thus, separating and carding are carried out sequentially with the same apparatus.

The second roller 264 eventually collects the fibers 258 and transfers them to the next stage of processing.

Seen in FIG. 18 is apparatus 278, wherein the fiber supply means 280 is a rotatable roller 282, provided, over the active surface thereof, with a plurality of pointed, tooth-like projections 284. Apparatus 278 uses dual-function teeth 286 for cleaning fibers 276, while simultaneously carrying out additional carding between adjacent rollers. Advantageously, rotatable roller 282 is provided, over the active surface thereof, with a plurality of pointed, tooth-like projections 284, of which a first quantity 284*a* point in the direction of rotation of the roller, and a second quantity 284*b* point in the opposite direction.

It will be noted from FIG. 18 that the apparatus includes a total of three rollers 282, 286, 288 having dual function teeth which operate in series, the fibers being partially carded and stripped at each intersection. The tooth size and pitch of the projections on each of the three rollers 282, 286, 288 become progressively finer in the direction of fiber movement.

Dirt and very short fibers are ejected through passages 290. Fibers are fed in by means of a pair of rollers 292, and are finally removed after processing by a stripper roller 294.

Referring now to FIG. 19, there is shown an apparatus including a Lickerin roller 302, working in conjunction with a cylinder roller 304, both of which move in the same direction in the manner described with regard to FIG. 17A. Said Lickerin roller is provided with a first quantity of pointed, tooth-like projections 306 and a second quantity of oppositely-pointed, tooth-like projections 308 on the surface thereof, with said tooth-like projections being shown in enlarged scale on the right-hand side of said Figure.

The cylinder roller 304 is provided with a plurality of teeth of uniform orientation (not shown), pointed in the direction of rotation of said cylinder.

In FIG. 20 there is seen the application of the present invention to an apparatus comprising a combination of a stripper roller 310, a worker roller 312 and a cylinder 314, wherein both said stripper roller and said worker roller are provided with a first quantity of pointed, tooth-like projections 316, 318 respectively and a second quantity of oppositely-pointed, tooth-like projections 320, 322 respectively, on the surfaces thereof; while said cylinder 314 is provided with a plurality of teeth of uniform orientation 324, pointed in the direction of rotation of said cylinder.

In the embodiment of FIG. 20, there will be additional carding between the worker roller and the stripper roller, as well as between the stripper roller and the cylinder, allowing an increase in the productivity of the carding machine.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An apparatus for cleaning fibers by means of a combination of revolving tooth rollers, the fiber mass being divided, expanded and recombined while being successively transferred over at least fourth rollers; the outer surface of at least one of said rollers revolving in close proximity to, but spaced apart from, two other rollers to form a triangular enclosure therebetween, said apparatus comprising:

a first roller arranged to collect fibers from a moving supply source and to effect the division and carding thereof;

a second roller driven at a peripheral speed different from that of said first roller, arranged to collect part of said fibers from said first roller and to expand said fiber mass collected therefrom, the resultant division and expansion of said fiber mass, and carding thereof, allowing ejection of at least some waste particles;

a third roller driven at least 5 times faster than either said first or said second roller, and arranged to receive, expand, card and eject fibers from said first roller and said second roller, and to eject waste particles from said fibers;

a fourth roller arranged to receive, collect and condense fibers from at least said third roller, and at least one separator blade held in proximity to one of said rollers for separating waste particles.

2. An apparatus according to claim 1, wherein the direction of the teeth in each two adjacent rollers of said triangular enclosure is point against point.

3. An apparatus according to claim 1, wherein said first roller is provided with dual-function teeth, a portion of said teeth being arranged to effect the collection of fibers from said supply source and another portion of said teeth being formed to affect carding in conjunction with an adjacent toothed roller.

4. An apparatus according to claim 1, wherein a tube is rotated into said triangular enclosure to prevent undesired air turbulence.

5. An apparatus according to claim 4, wherein said tube is perforated for supplying a flow of compressed air.

6. An apparatus according to claim 1, further comprising a dust passage leading from the vicinity of said separator blade to a dust collection container.

7. An apparatus according to claim 1, further comprising an open trap for collection of dust and waste particles positioned within said triangular enclosure.

8. An apparatus according to claim 7, wherein said dust and waste particles are collected into said open trap by means of suction.

9. An apparatus according to claim 1, wherein the last roller of said apparatus is arranged to effect the return of cleaned fibers to said supply source for further processing by other apparatus.

10. An apparatus according to claim 9, wherein said supply source is a doffer.

11. The apparatus according to claim 1, wherein the outer surface of at least one of said rollers revolves in close proximity to, but spaced apart from, two other rollers to form a triangular enclosure therebetween, and wherein a separator is disposed in said triangular enclosure to prevent undesired air turbulence.

12. The apparatus according to claim 11, wherein said separator is arranged for separating dust and waste particles from fibers into an open trap, to be collected therein.

13. The apparatus according to claim 12, wherein said dust and waste particles are collected in said open trap by means of suction.

14. The apparatus according to claim 1, wherein said first roller is a doffer of a carding machine.

* * * * *